United States Patent [19]

Bouvet

[11] 4,378,253

[45] Mar. 29, 1983

[54] MACERATION SYSTEM FOR MILLING SUGAR CANE

[76] Inventor: Jean Bouvet, 1319 Butterfield Rd., San Anselmo, Calif. 94960

[21] Appl. No.: 284,593

[22] Filed: Jul. 20, 1981

[51] Int. Cl.[3] ..... C13D 1/10; C13C 3/00

[52] U.S. Cl. ..... 127/6; 127/5; 100/70 A; 100/74; 100/75; 100/121

[58] Field of Search ..... 100/73, 74, 75, 70 A, 100/121; 127/6, 2, 3, 4, 5

[56] References Cited

U.S. PATENT DOCUMENTS

| | | | |
|---|---|---|---|
| 182,377 | 9/1876 | Mallon | 100/75 |
| 1,124,643 | 1/1915 | Ogg | 127/2 X |
| 1,346,594 | 7/1920 | Deerr | 100/75 |
| 1,834,852 | 12/1931 | Kutter | 100/121 |
| 1,908,519 | 5/1933 | Leonard | 100/121 X |
| 2,061,196 | 11/1936 | Hymers | 100/75 X |
| 3,468,242 | 9/1969 | Schaffrath | 100/121 |
| 3,878,698 | 4/1975 | Friksson et al. | 100/75 X |
| 3,974,026 | 8/1976 | Emson et al. | 100/121 X |

*Primary Examiner*—Kenneth M. Schor
*Attorney, Agent, or Firm*—Melvin R. Stidham

[57] ABSTRACT

Disclosed is a maceration system of the type generally used in the grinding and juice extraction of sugar cane. The last mill has a roll and feed and discharge bottom rolls with elongated trash plate spanning the space between the bottom rolls. Separate troughs extend below each of the bottom rolls to catch and separate juice therefrom. The top roll has longitudinal flow passageways around it opening into ports in the roll surface and water is introduced through these passgeways to flow into the pulp moving over the trashplate to the discharge roll, and the juice from below the discharge roll is directed to the pulp moving to the feed roll. In the case of multiple mills in tandem, the juice recovered from the feed roll is directed to the top roll passageways of the previous mill and the juice from the discharge roll of that mill is directed to the feed roll thereof.

6 Claims, 4 Drawing Figures

MACERATION SYSTEM FOR MILLING SUGAR CANE

BACKGROUND OF THE INVENTION

This invention is directed to a maceration system used in the grinding and juice extraction of sugar cane and the like by the milling process. It is generally accepted in the industry that the most effective type of maceration is the so called, "Compound Maceration" system whereby the imbibition water is added to the bagasse blanket as it enters the last mill of the milling tandem, and all of the liquid collected from beneath the three rolls of that mill is delivered as maceration onto the pulp or bagasse blanket entering the preceding mill of the tandem. This same process is repeated in turn for each mill in a tandem until the totality of the maceration extracted by all of the mills of the tandem appears as the liquid extracted by the first mill of the tandem as "mixed juice" which is further processed in another section of the sugar factory.

It is generally accepted in the cane sugar industry that the amount of sugar juice recovered from the individual mills of the tandem, as well as by the tandem in its entirety, is directly proportional to the amount of washing given to the bagasse material by the maceration system as it proceeds through the mill tandem. However, in the conventional maceration system, the maximum number of washes is limited to one per mill and, in addition, the flow of maceration liquid is restricted in such systems because of inadequate drainage channels for the juice.

OBJECTS OF THE INVENTION

It is an object of this invention to provide a maceration system wherein the amount of washes given to a tandem of mills is greatly increased.

It is a further object of this invention to provide a maceration system wherein each mill unit in a tandem thereof may receive two washes.

Other objects and advantages of this invention will become apparent from the description to follow, particularly when read in conjunction with the accompanying drawings.

SUMMARY OF THE INVENTION

In carrying out this invention I provide a maceration system having a tandem of three roll mills, with at least the top mill roll being constructed in accordance with my U.S. Pat. No. 3,969,802 granted July 20, 1976 for "Mill Roll". There, the roll has longitudinal passageways around it and below the surface, with generally radial openings extending from the surface inward to the longitudinal passageways so that juices extracted from the pulp are conducted through the passageways to discharge at the ends of the roll, thereby greatly increasing the efficiency of the mill and its capacity for juice extraction. In each mill of the tandem, there is a top roll and feed and discharge bottom rolls, with a trash plate spanning the space between the bottom rolls, over which pulp is transported in the transition between the two grinding stages of the mill. Separate troughs are disposed beneath the feed and the discharge rolls to collect juice squeezed thereby. Imbibition water is introduced through the longitudinal passageways in the top roll of the last mill from one end thereof. The other end is blocked off so that the liquid exits through the radial openings to discharge on the pulp moving over the trash plate to the discharge roll. The relatively thin juice below the discharge roll is ducted to the pulp moving to the feed roll, and the slightly denser juice from the trough below the feed roll is ducted to an end of the longitudinal passageways in the top roll of the next previous mill and discharge on the pulp moving over the trash plate between the feed and discharge rolls there. Hence, in each mill, in the tandem, the thinner maceration liquid is delivered to the longitudinal roll passageways to mix with the pulp moving over the trash plate, and the slightly denser juice recovered from this wash is delivered to the pulp entering the feed roll. The densest juice collected from the feed roll is delivered to the longitudinal passages in the top roll of the next previous mill. In the case of the last mill the "thinner liquid" is the imbibition water; in the case of other mills, it is the liquid from below the feed roll of the next succeeding mill.

BRIEF DESCRIPTION OF THE DRAWING

In the drawings, in which like characters of reference designate like parts throughout the several views thereof.

DESCRIPTION OF A PREFERRED EMBODIMENT

Figure 1:
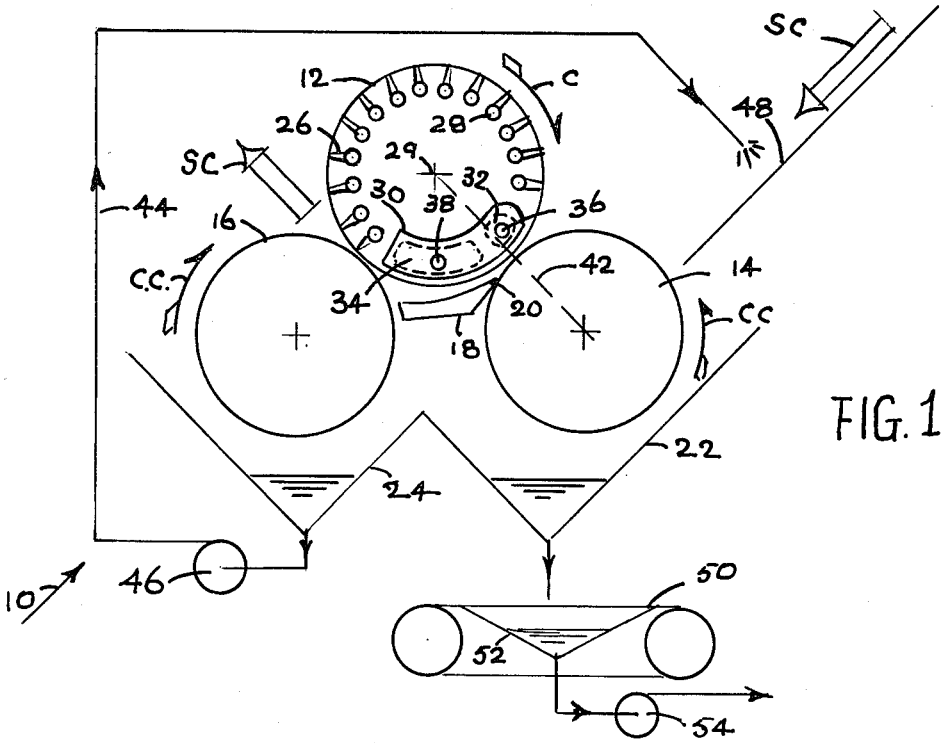
FIG. 1 is a schematic digram of the maceration system of this invention as it applies to the last mill of milling tandem.

Referring now to FIG. 1 with greater particularity there is shown the last mill 10 of a juice extraction system which may have several mills in tandem, as will be described. Of course, where just one mill is employed, the only mill is the "last mill". In any event, the mill comprises a top mill roll 12 and feed and discharge bottom rolls 14 and 16. As indicated by the arrows the top roll rotates in one direction C, i.e. clockwise in FIG. 1, while the lower rolls rotate in the opposite, counterclockwise direction C.C. The sugar cane or other pulp from which juice is extracted, moves in the direction of the arrows S.C., first between the feed and top roll 14 and 12, and then between the discharge and top rolls 16 and 12, and in the transition stage, the sugar cane or bagasse passes over a trash plate 18 spanning the space between the two lower mill rolls. The pulp mass is stripped from the lower feed roller 14 by the leading edge 20 of the trash plate 18.

Separate troughs 22 and 24 are disposed beneath the feed and discharge rolls 14 and 16, so that juices of progressively less density are collected separately.

At least the top roll 12, and preferably both the top and discharge lower rolls 12 and 16, are constructed in accordance with my U.S. Pat. No. 3,969,802 wherein a series of perforations or ports 26 extending in rows across the rolls 12 open into longitudinal passageways 28 which extend around and generally parallel to the roll axis 29 of the rolls 12 and 16, whereby juice squeezed from the pulp S.C. is carried through the perforations 26 and passageways 28 to be discharged from the ends of the roll 12 and into the troughs 22 and 24. This greatly increases the juice extraction capacity of the system and enables it to accommodate the increased liquid circulation of the present invention.

Figure 2:
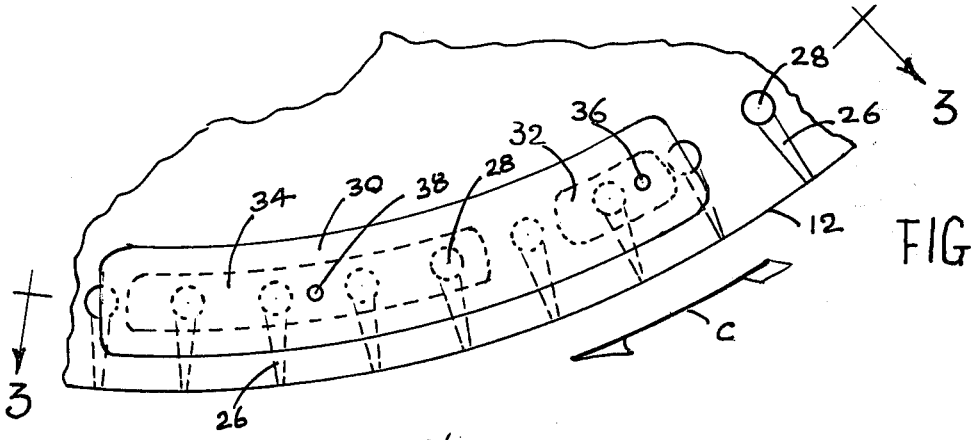
FIG. 2 is a partial plan view of the header which is a feature of this invention.
Figure 3:
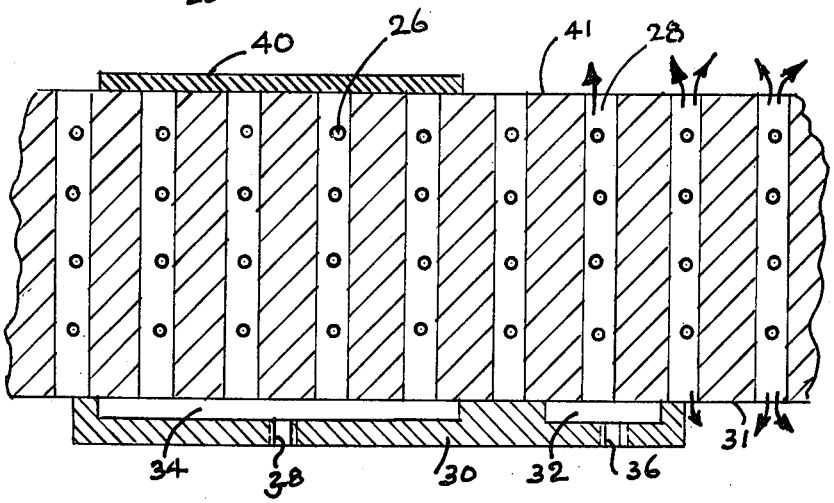
FIG. 3 is a section view taken along line 3—3 of FIG. 2.

As a particular feature of this invention an arcuate, compartmented stationary header 30 (FIGS. 2 and 3) is pressed by any suitable means (not shown) to seal against the circular end 31 of the top roll 12. The header is divided into two arcuate compartments 32 and 34 which seal around the ends of the longitudinal passages 28 in the roll 12 as they rotate through. The compartment 32 is connected at 36 to a source of steam, and the compartment 34 is connected at 38 to a source of imbibition water (not shown). A seal plate 40 is pressed against the opposite end 41 of the roll 12 to cover those longitudinal passageways embraced by the liquid dispensing compartment 34 of the header 30.

In operation, as each longitudinal roll passageway 28 moves into the gas distributing compartment 32 of the header 30, a charge of gas, preferably steam blows completely through that passageway 28 to force out any liquid remaining from the first milling stage wherein the pulp was compressed between rolls 12 and 14. It is understood that the term "gas" as used herein is broad enough to include steam, as well as compressed air, although steam is the preferred medium. The first compartment 32 is situated in the end portion of the first compression stage where the converging space between the rolls 12 and 14 passes through in common centerline 42 of the two rolls.

Thereafter, the space gradually enlarges, and it is in this decompression stage that the second compartment 34 is located for introduction of maceration fluid into the passageways 28 embraced thereby. Because the opposite ends of these passageways are blocked by seal plate 40, the liquid is forced out through to ports 26 and onto the bagasse on the trash plate 18. Since the bagasse is in an expanding mode following maximum compression, it readily absorbs the maceration liquid.

It is important that the compartment 34 be located at the very beginning of the expansion stage so that liquid, and not air, will enter the expanding, previously crushed cells which contained the sugar juices. For the same reason, steam is the preferred medium for blasting through from the first compartment 32.

A duct system 44 pumps fluid at 46 from the last mill discharge roll trough 24 onto the pulp S.C. entering the feed end of the mill between feed rolls 14 and top roll 12. Hence, each mill in a tandem is subjected to two washings, first by the less dense of two liquids available, by flowing at 38 through the header compartment 34, longitudinal passageways 28 and ports 26 onto the pulp on the trash plate 18, and second by the somewhat more concentrated fluid collected at the trough 24 and delivered at the feed 42. In the case of the last mill 10 in a system, the thinner fluid being introduced at header 30 is the imbibition water. This is twice the number of washings in the conventional system, which has just one wash per mill.

Figure 4:
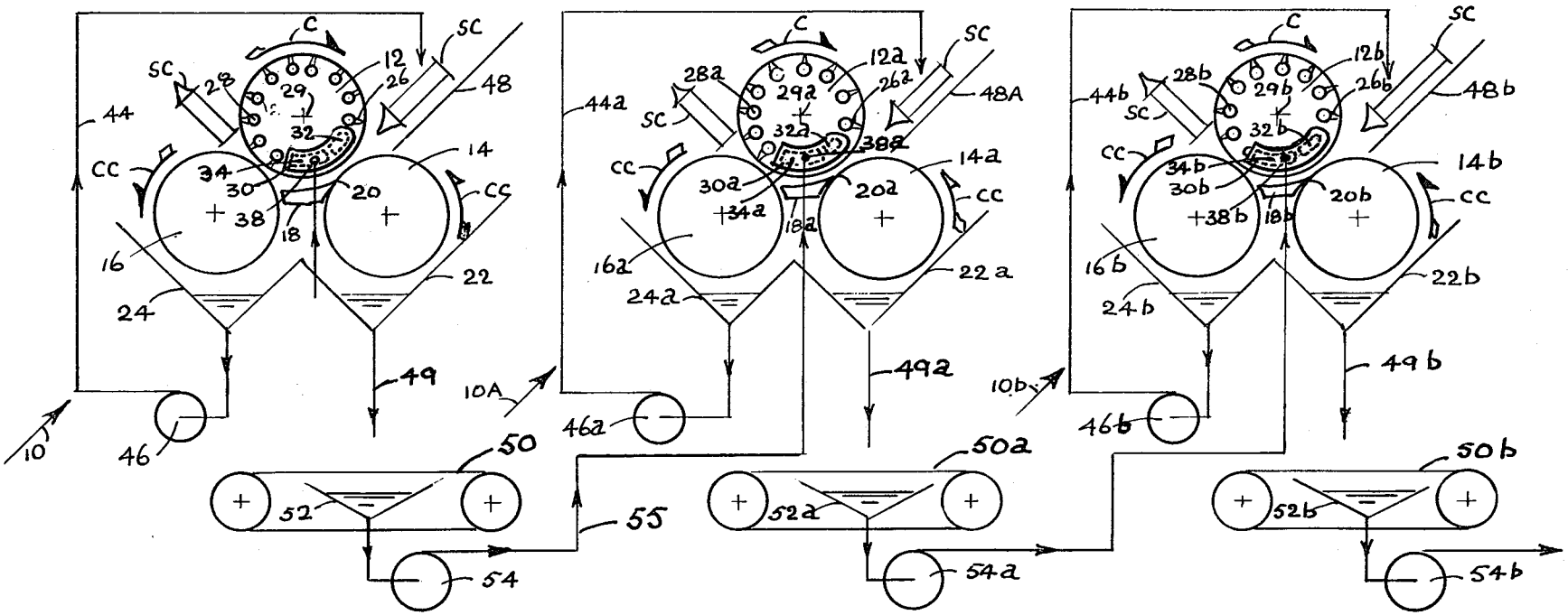
FIG. 4 is a schematic diagram of the maceration system as it applies to a complete milling tandem.

Referring now to FIG. 4, there is shown a multi-mill system in tandem including, in addition to the last mill 10 an intermediate or penultimate mill 10A and a preliminary or first mill 10B, the components of the intermediate 10A and preliminary mill 10B being numbered the same as corresponding components in the last mill 10 with the addition of the letters "a" and "b", respectively, after the corresponding reference numerals.

Again, the imbibition water is introduced at header chamber 34 through the last mill top roll 12 and the relatively light liquid from the final discharge trough 24 is delivered to the feed end 48 of the last mill 10. At the same time, the slightly denser liquid is removed at 49 from the feed roll trough 22 and screened through a cush-cush strainer 50 to a collecting trough 52, in accordance with the conventional practice. However, in accordance with this invention, the liquid so strained is then pumped at 54 through the duct circuit 55 to the imbibition inlet **38*a* where it is delivered at header liquid chamber 34*a* and discharged into pulp being passed to the discharge and top rolls 16*a* and 12*a*, of the penultimate mill 10A**.

Similarly in the second unit the lighter of two fluids being collected, that in trough **24*a*, but slightly more concentrated than that delivered at the header 34*a* from the last mill 10, is delivered to the pulp S.C. at the feed roll 14*a* and the more concentrated fluid in trough 22*a* is delivered to the header 34*b* in the preliminary mill 10B. There, the lighter fluid being collected in trough 24*b* is delivered to the feed rolls 12*b*, 14*b* and the most concentrated fluid in the system is screened at 50*b*; delivered to the trough 52*b* and then is pumped away at 54*b*** for treatment at another area of the plant.

While this invention has been described in conjunction with a preferred embodiment thereof, it is obvious that modifications and changes therein may be made by those skilled in the art without departing from the spirit and scope of this invention, as defined by the claims appended hereto.

Having described my invention, I claim:

1. In a juice extracting maceration system comprising:

a mill having:

a top mill roll, said top mill roll having a plurality of longitudinal rows of perforations around the cylindrical surface thereof and a plurality of longitudinal passageways through and around said roll below the surface thereof said passageways being in flow communication with said rows of perforations so that juice squeezed from pulp will flow first radially into said perforations and then laterally through said longitudinal passageways;

feed and discharge bottom mill rolls, each disposed cooperatively with said top mill roll to mill pulp between it and said top mill roll;

a trash plate substantially spanning the space between said feed and discharge bottom rolls over which crushed pulp is transported;

a first trough underlying said discharge mill roll to catch juice squeezed from pulp between it and said top mill roll; and a second trough underlying said feed mill roll to catch juice squeezed from pulp between it and said top mill roll;

a wash system comprising:

a stationary header in slidable sealing engagement with one end of said top mill roll;

a liquid distributing compartment defined in said header;

peripheral walls defined in said header, located around said liquid distributing compartment and embracing at all times the entrance to at least one of said longitudinal passageways;

a stationary blocking member engaging the other end of said top mill roll in alignment with said stationary header to prevent flow of liquid from said at least one longitudinal passageway; and means for introducing a liquid to said liquid distributing compartment with the system being arranged such that the introduced liquid flows first laterally through said at least one flow passageway and then radially out through the row of perforations connected thereto and onto crushed pulp on said trash plate.

2. The maceration system defined by claim 1 wherein: said liquid distributing compartment is situated closely downstream of the maximum zone of compression between said top mill roll and said feed mill roll.

3. The maceration system defined by claim 1 wherein: said liquid distributing compartment is of arcuate configuration and long enough to embrace at all times several of said longitudinal passageways beginning closely downstream of the maximum zone of compression between said top mill roll and said feed mill roll.

4. The maceration system defined by claim 1 where in said stationary header includes:

a gas distributing compartment defined in said header and embracing at all times at least one other of said longitudinal passageways immediately upstream from that passageway embraced by said liquid distributing compartment; and means for introducing a pressurized gas to said gas distributing compartment to evacuate a longitudinal passageway embraced thereby.

5. The maceration system defined by claim 1 including:

means defining a port opening into said water distributing compartment;

first duct means for conducting water to said port;

second duct means to conduct liquid from said first trough to discharge same onto the path of pulp moving to said feed mill roll; and a pump in said second duct means.

6. The maceration system defined by claim 4 wherein said mill is the last mill in a tandem array of mills and including:

a penultimate mill having a penultimate top mill roll;

said penultimate top mill row having a plurality of longitudinal rows of performation around the cylindrical surface and a plurality of passageways through and around said penultimate top roll below the surface thereof, each of said rows of perforations opening into one of said passageways;

penultimate feed and discharge bottom mill rolls, each disposed cooperatively with said top roll to mill pulp between it and said penultimate top mill roll;

a penultimate mill trash plate substantially spanning the space between said feed and discharge bottom mill rolls over which crushed pulp is transported;

a third trough underlying said penultimate discharge mill roll to catch juice squeezed from pulp between it and said penultimate top mill roll;

a fourth trough underlying said preliminary feed mill roll to catch juice squeezed from pulp between it and said penultimate top mill roll;

a penultimate stationary header engaging one end of said penultimate top mill roll;

a penultimate water distributing compartment in said header embraching at all times at least one of said longitudinal passageways;

a penultimate blocking member engaging the other end of said penultimate top mill roll; and means defining a second port opening into said penultimate water distributing compartment;

third duct means for directing the juice from said second trough to said second port;

fourth duct means for conducting juice from said third trough to pulp moving to said penultimate feed mill roll; and pumps in said third and fourth ducts.

* * * * *